United States Patent [19]

Waxmanski

[11] 3,974,917

[45] Aug. 17, 1976

[54] SHOE RACK STACK

[76] Inventor: Andrew Waxmanski, 3436 Brinkley Road, Temple Hills, Md. 20031

[22] Filed: Aug. 25, 1975

[21] Appl. No.: 607,483

Related U.S. Application Data

[63] Continuation of Ser. No. 441,846, Feb. 12, 1974, abandoned.

[52] U.S. Cl. ..... 211/36; 108/111; 211/148

[51] Int. Cl.[2] ..... A47F 7/08

[58] Field of Search ..... 211/34–37, 211/126, 134, 148, 183, 177; 108/91, 153, 109, 111; 248/224, 235, 242, 250, 239; 206/509, 512

[56] References Cited

UNITED STATES PATENTS

| | | | |
|---|---|---|---|
| 753,678 | 3/1904 | Dannenberg | 108/91 |
| 1,238,275 | 8/1917 | Deeley | 211/36 |
| 1,589,198 | 6/1926 | McComb | 211/36 X |
| 2,583,931 | 1/1952 | Cummings | 108/111 UX |
| 2,847,127 | 8/1958 | Glassenberg | 211/34 |
| 3,295,695 | 1/1967 | Carmstrom | 211/148 |
| 3,788,241 | 1/1974 | Ravreby | 211/36 X |

*Primary Examiner*—Roy D. Frazier
*Assistant Examiner*—Robert W. Gibson, Jr.
*Attorney, Agent, or Firm*—LeBlanc & Shur

[57] ABSTRACT

The shoe rack includes a pair of end supports and a platform releasably secured between the end supports. The platform is inclined from one side to the other and has a central upstanding shoulder providing a step for engagement by the heels of shoes for retaining the shoes on the platform. Like units similarly formed are stacked one on top of the other to provide a plurality of superposed platforms for supporting the shoes. The end supports of each underlying rack have upstanding pins cooperative with the margins of openings through the lower edges of the end supports of the next superposed rack for releasably securing the racks in stacked superposed relation one on top of the other. For an elongated rack, a central support is provided for supporting the intermediate portion of the platform. For a plurality of superposed elongated racks, a central support is provided between superadjacent platforms whereby intermediate portions of each platform are supported from the next underlying platform by essentially a column of such central supports.

2 Claims, 10 Drawing Figures

FIG.1
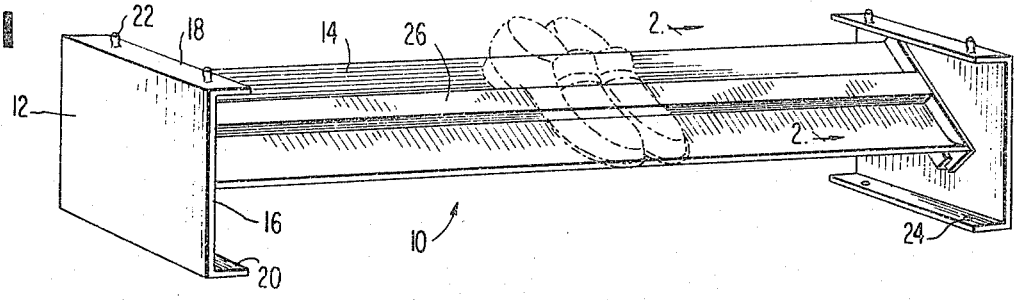
FIG.2
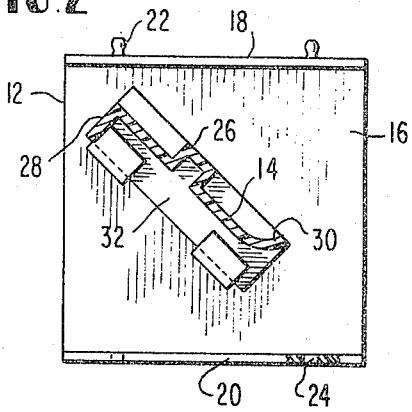
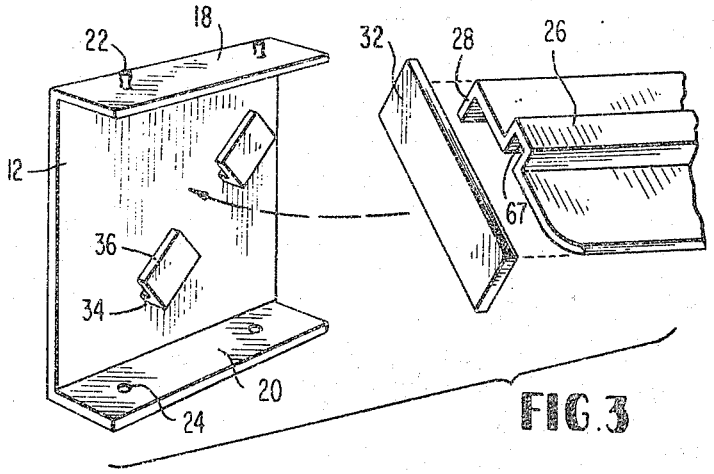
FIG.3
FIG.8
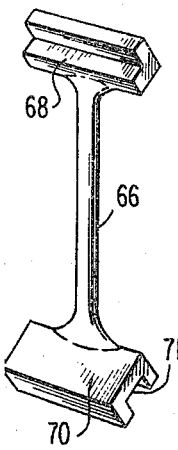
FIG.7
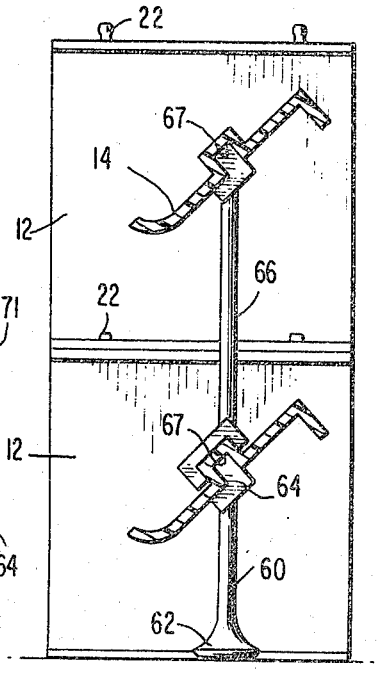
FIG.5
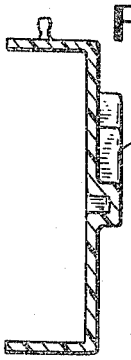
FIG.4
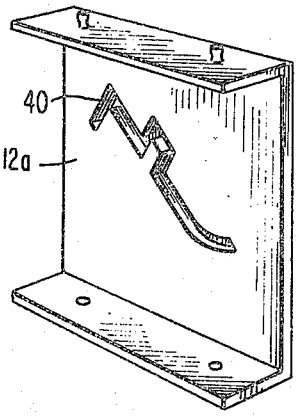
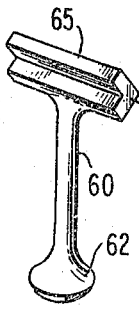
FIG.9
FIG.6
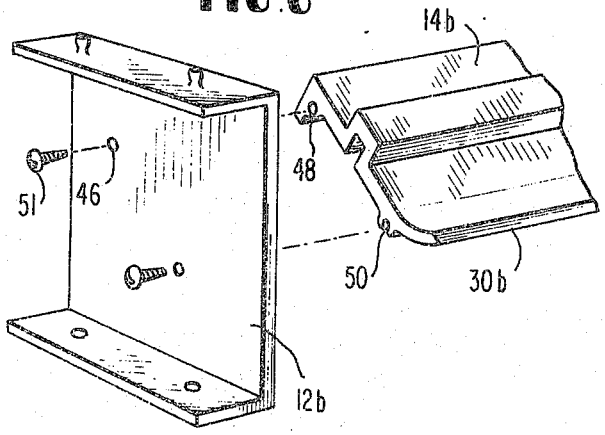
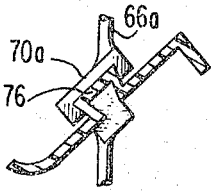
FIG.10

SHOE RACK STACK

This is a continuation of application Ser. No. 441,846 filed Feb. 12, 1974 now abandoned.

The present invention relates to a shoe rack or stand and particularly relates to a stand for supporting shoes and which stand may be provided in multiple units capable of releasable securement one to the other and in superposition one over the other whereby shoes may be stored in reasonably compact space.

Prior shoe racks normally comprise an inclined platform disposed between a pair of end supports with the heel portions of the shoes engaged over the upper edge of the platform or a rise intermediate the edges of the platform. These racks are more often than not, however, not readily assembled, quite cumbersome, and cannot be stacked one on top of the other whereby such prior shoe racks are limited in their capacity to hold shoes. Moreover, certain shoe racks are required to be of substantial length particularly those racks utilized in commercial establishments for displaying shoes. Consequently, there is a problem in providing support for the intermediate portions of the platform such that the platform and shoes carried thereby do not sag. Furthermore, prior constructed shoe racks are normally relatively expensive to construct.

The present invention provides a shoe rack which minimizes and/or eliminates problems associated with prior shoe racks and provides a novel and improved shoe rack having various advantages in construction, mode of use and result in comparison with such prior shoe racks. Particularly, the present invention provides a shoe rack which can be used either singly or in combination with other like racks or units. The units may thus be stacked in super-position one over the other and also secured one to the other whereby a plurality of shoe rack units may be provided in a relatively small compact space thus significantly increasing the capacity of the shoe storage area. More particularly, each shoe rack, whether used individually or in super-position with other units, comprises a pair of end supports having inturned flanges along their upper and lower edges. A platform is disposed between the end supports and releasably secured at opposite ends to the respective end supports and between the flanges. The platform is inclined downwardly from the back of the stand to the front of the stand and carries an upstanding shoulder intermediate its front and rear edges whereby heel portions of shoes engage against the shoulder for supporting the shoes on the platform in an inclined position. To secure the platform to the end supports, and in one form hereof, there is provided on each end support a pair of inwardly and upwardly projecting tabs which receive a corresponding end plate carried at the end of the platform. The tabs incline substantially similarly as the platform whereby the end plate of the platform is locked between the tabs and the end wall of the end support. In another form hereof, the end supports are provided with an inwardly opening slot which conforms in shape to the cross-sectional shape of the platform. The platform may thus be inserted within the slot and retained therein for example by glue or epoxy. Alternately, the platform can be releasably secured to the end supports, for example by using screws.

To enlarge the storage capacity of the shoe rack, a plurality of such units as described above may be provided. The upper flanges of the end supports and the lower flanges of superposed end supports are provided with releasable locking devices whereby the end supports and hence the units can be stacked and secured in superposed relation one over the other. By locating the end supports of one unit in vertical registry over the end supports of another unit and releasably securing each to the other, the platforms will lie in vertical registry one with the other and the capacity of the unit will be increased. Such releasable securement devices may comprise pins which project upwardly from the upper edges of the lower end supports, the pins having enlarged heads for reception in openings in the lower flanges of the superposed end supports. For an elongated unit, a central support is provided for the platform. Where units are superposed one over the other, additional central supports are interposed between next adjacent platforms whereby the uppermost platform is centrally supported by a column of vertically registering posts from the lowermost platform.

Accordingly, it is a primary object of the present invention to provide a novel and improved shoe rack.

It is another object of the present invention to provide a novel and improved shoe rack which is simple in construction, readily assembled, and inexpensive to manufacture.

It is still another object of the present invention to provide a novel and improved shoe rack having enlarged capacity for storing shoes.

It is a further object of the present invention to provide novel and improved shoe rack units which can be superposed one over the other and secured in such superposition thereby to economize the space required for storing shoes.

It is a still further object of the present invention to provide a novel and improved shoe rack unit which is elongated and readily and easily supported by a central support post.

It is a still further object of the present invention to provide novel and improved shoe rack units which can be superposed one over the other and supported intermediate their ends by interconnecting the platforms one to the other by center support posts to thereby provide columnar-type support.

These and further objects and advantages of the present invention will become more apparent upon reference to the following specification, appended claims and drawings, wherein:

FIG. 1 is a perspective view of a novel and improved shoe rack constructed in accordance with the present invention;

FIG. 2 is a cross-sectional view thereof taken generally about on line 2—2 in FIG. 1;

FIG. 3 is an exploded perspective view of the end supports, platform end plate, and the platform prior to connection of the platform to the end support;

FIG. 4 is a perspective view of another form of end support for the shoe rack stand hereof;

FIG. 5 is a vertical cross-sectional view of the end support illustrated in FIG. 4;

FIG. 6 is an exploded perspective view of an end support and platform constructed in accordance with another form of the present invention;

FIG. 7 is a vertical cross-sectional view illustrating the manner in which identical shoe rack units are superposed one over the other;

FIG. 8 is a perspective view of the center post for supporting the superposed platform from the underlying platform;

FIG. 9 is a perspective view of the center post support for supporting the platform from ground elevation; and FIG. 10 is a fragmentary perspective view illustrating another form of connection between the center post supports and a platform.

Referring now to the drawings, and particularly to FIG. 1, there is illustrated a shoe rack, generally designated 10, constructed in accordance with the present invention and comprising end supports 12 and a platform 14 secured between end supports 12. Each end support 12 comprises an upstanding, generally square, end wall 16 having inwardly directed upper and lower flanges 18 and 20 respectively. For reasons noted hereinafter, each upper flange 18 has a pair of upwardly projecting pins 22 spaced therealong, the pins having enlarged heads. Each lower flange 20 has a pair of openings 24 at like spaced positions therealong as pins 22, the openings 24 having a slightly reduced diameter in comparison with the enlarged head portions of pins 22.

Platform 14 is elongated, preferably formed from extruded plastic material, and comprises an elongated generally flat surface having an intermediate shoulder 26 which projects upwardly intermediate opposite edges of the platform 14. The back edge of platform 14 is provided with a downwardly extending flange 28 while the opposite front edge of the platform 14 is curved upwardly to form a lip 30. End plates 32 are provided on the ends of platform 14 and may be secured thereto for example by an epoxy. The end plates 32 are rectangular and have length and width dimensions approximating the length and height of the platform 14.

To secure platform 14 to the end supports 12, each end support 12 is provided with a pair of inwardly projecting tabs 34 having upstanding flanges 36. Tabs 36 are aligned on a diagonal along end supports 12 and which diagonal corresponds to the inclination of platform 14 when secured between end supports 12. To assemble the shoe rack described above, the end plates 32 carried by the platform are inserted between the upstanding flanges 36 and the end walls 16 of the end supports. The flange 28 on the rear side of platform 14 engages the uppermost tab 34 and prevents the platform from sliding downwardly along the tabs in the direction of its inclination. The lower edge of the end plate 32 seats on each of the lower edges of tabs 34 and thus platform 14 is supported in a stable position between end supports 12. It will be apparent that shoes can be disposed and stored on platform 14 when the unit is thus assembled by engaging the front face of the heel of the shoes against the rear face of the shoulder 26, the upwardly extending lip 30 also assisting to prevent the shoes from falling from the rack.

Referring now to FIGS. 4 and 5, there is illustrated another form of securement between platform 14 and end supports 12. Particularly, the end supports 12*a* illustrated in FIGS. 4 and 5 are similarly configured as the end supports 12 described above in connection with the embodiments illustrated in FIGS. 1–3 except for the manner in which the platform is secured thereto. Instead of inwardly projecting tabs 34, each end support 12*a* is provided with a slot 40 which opens inwardly. Slot 40 conforms in shape to the cross-sectional shape of the platform 14. The slot is closed along the outer wall of each end support 12*a* by a boss 42. Thus the ends of the platform 14 can be inserted into the slots 40, with the platform being fully supported thereby. An expoxy can be applied prior to insertion of the platform ends into the slots in order to permanently secure the platform to the end supports. Alternately, the bosses 42 may be provided with set screws to clamp the end supports 12*a* to the opposite ends of platform 14.

FIG. 6 illustrates a further form of securement between the end supports 12*b* and platform 14*b*. End supports 12*b* are similar to the end supports 12 disclosed in the embodiment of FIGS. 1–3 except for the manner of their attachment to platform 14*b*. In lieu of the tabs 34 or slots as illustrated in FIGS. 4–5, each end support 12*b* is provided with a pair of openings 46 which lie on a diagonal line corresponding to the inclination of platform 14*b*. The end portions of platform 14*b* and along its underside are enlarged to receive screws. Particularly, screw holes 48 and 50 are provided in enlarged portions of platform 14*b* respectively between the juncture of flange 28 and the platform 14*b* on the one hand and along the underside of the platform adjacent lip 30*b* on the other hand. Screws 51 are receivable through openings 46 and within openings 48 and 50, respectively, whereby the platform 14*b* can be releasably secured at opposite ends to the end supports 12*b*.

Referring now to FIGS. 7–9, there is illustrated a pair of like shoe rack units superposed one over the other, the units corresponding to those described in the embodiments illustrated in FIGS. 1–3 although it will be appreciated that the other embodiments of the units disclosed herein can be utilized in this superposed configuration. Particularly, the units can be superposed one over the other and releasably secured to one another by inserting the upstanding pins 22 on the upper flanges 18 of the end supports 12 through the openings 24 in the lower flanges 20 of the superposed end supports 12. For particularly long platforms, and which platforms require support intermediate end supports 12, a central post 60 is provided. Particularly, central post 60 is comprised of a lower enlarged pedestal 62 and an upper end which terminates in a slightly elongated inclined angle 64 (see FIG. 9). It will be appreciated that the center post 60 has a height such that lower pedestal 62 lies at an elevation coincident with the elevation of the lower flanges 20 of end supports 12. The upwardly projecting flange 65 of the upper angle 64 is received within the groove 67 formed along the underside of platform 14 by shoulder 26. Due to the inclination of the platform, the flange 65 of angle 64 is maintained within the groove by the weight of platform 14 and the shoes located thereon and it will thus be appreciated that the lower elongated platform is centrally supported by the central post 60. The central post 60 may be used for supporting intermediate portions of the platform of a single elongated shoe rack. It is also used when elongated racks are stacked one upon the other as illustrated in FIG. 7. In this latter situation, one or more central supports 66 are provided depending upon the number of racks to be superposed. Central support 66 is particularly illustrated in FIG. 8 and has, at its upper end, an angle 68 similar to the angle 64 of lowermost support 60 described previously. Support 66 terminates at its lower end in a channel 70. Channel 70 is disposed on the lower end of post 66 at an angle corresponding to the angle of inclination of the platform 14. Moreover, the groove 71 defined by the channel is formed slightly larger than the shoulder 26 on platform 14. Accordingly, to support an upper platform from a lower platform and centrally of the stack units, the lower central support 60 is first installed as described previously. The upper support 66 is then interposed between two platforms 14 with the channel 70 overlying shoulder 26. The flange of the angle 68 is received in the groove 67 of the shoulder 26 of the upper platform whereby the central support post 66 is releasably clamped between the two superposed platforms. Also, posts 60 and 66 lie in vertical registry one with the other whereby a vertical column type support is provided. It will be appreciated that additional units can be stacked on top of the two units illustrated in FIG. 7 similarly as the uppermost unit is stacked on the lowermost unit as illustrated.

Referring now to FIG. 10, another form of connection between the central posts and the platform is illustrated. In this form, the shoulder 76 formed on the platform has a dovetail cross-sectional shape. The lower channel 70*a* of the central posts 66*a* has a similarly configured groove whereby the center post can be either snapped over or slidably received along dovetail groove 76. The flange on the angle of the lower post may also be dovetail in shape and slidably received within the groove formed by the formation of the dovetailed shoulder 76.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by United States Letters Patent is:

1. A shoe rack comprising:

a pair of end supports, an elongated platform disposed endwise between said end supports and inclined downwardly from one side of the shoe rack to its other side and having flange portions downwardly inclined from said one side thereof and adjacent opposite ends of said platform, means for securing the end supports to the opposite ends of said platform respectively including means carried by said end supports and engageable with said flange portions, an elongated shoulder upstanding from said inclined platform intermediate its opposite edges and substantially coextensive in length with said platform for retaining shoes on said platform, a support for said platform intermediate said end supports and comprising an element upstanding from an elevation common with the elevation of the lower edges of said end supports to an elevation for supportive engagement with said platform, and means for releasably securing the upper end portion of said element to said platform, the underside of said platform being recessed, the upper end of said element having a part receivable within said recess, said recess being substantially coextensive in length with said platform whereby said element can be located at selected positions along said platform with said part receivable in said recess at selected positions therealong.

2. A shoe rack comprising:

a pair of end supports, an elongated platform disposed end-wise between said end supports and inclined downwardly from one side of the shoe rack to its other side, said platform having flange portions downwardly inclined from one side thereof and adjacent the opposite ends thereof, means for securing the end supports to the opposite ends of said platform including means carried by said end supports and engageable with the flange portions of said platform, an elongated shoulder upstanding from said inclined platform intermediate its opposite edges and substantially coextensive in length with said platform for retaining shoes on said platform, a second pair of end supports and a second elongated platform disposed endwise between said second pair of end supports and inclined downwardly from one side of the shoe rack to the other side thereof, said second platform having flanged portions downwardly inclined from one side thereof and adjacent the opposite ends thereof, means for securing said second platform end supports to the opposite ends of said second platform respectively including means carried by said second pair of end supports and engagable with the flanged portions of said second platform, an elongated shoulder upstanding from the second inclined platform intermediate its opposite edges and substantially coextensive in length therewith for retaining shoes on said second platform, said second pair of end supports and said second platform being superposed over the first mentioned pair of end supports and the first mentioned platform respectively, means for releasably connecting the first and second pair of end supports to one another to retain the same and the platforms carried thereby superposed one over the other the underside of each of said platforms having a recess, a support for each of said platforms intermediate the corresponding end supports and comprising an element having an upper end at least in part receivable within the recess, the lower end of said element being engagable with said shoulder of the underlying platform, said recess in the superposed platform being substantially coextensive in length with the corresponding platform whereby the element can be located at selected positions along the platform with said part receivable in said recess at selected positions thereupon, and whereby said upper platform is supported from said lower platform.

* * * * *